US008085113B2

(12) United States Patent
Tzuang et al.

(10) Patent No.: US 8,085,113 B2
(45) Date of Patent: Dec. 27, 2011

(54) COMPLEMENTARY-CONDUCTING-STRIP COUPLED-LINE

(75) Inventors: Ching-Kuang Tzuang, Taipei (TW); Meng-Ju Chiang, Taipei (TW); Shian-Shun Wu, Taipei (TW)

(73) Assignees: National Taiwan University, Taipei (TW); CMSC, Inc., Hsinchu (TW)

( * ) Notice: Subject to any disclaimer, the term of this patent is extended or adjusted under 35 U.S.C. 154(b) by 252 days.

(21) Appl. No.: 12/484,657

(22) Filed: Jun. 15, 2009

(65) Prior Publication Data

US 2010/0148885 A1 Jun. 17, 2010

(30) Foreign Application Priority Data

Dec. 15, 2008 (TW) ..... 97148697 A

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 111, 112, 115, 116, 238
See application file for complete search history.

(56) References Cited

U.S. PATENT DOCUMENTS

| | | | | |
|---|---|---|---|---|
| 4,139,827 | A * | 2/1979 | Russell | 333/116 |
| 4,677,399 | A * | 6/1987 | Le Dain et al. | 333/116 |
| 7,049,905 | B2 * | 5/2006 | Chen | 333/116 |
| 7,084,715 | B2 * | 8/2006 | Al-Taei et al. | 333/24 R |
| 2010/0109790 | A1 * | 5/2010 | Tzuang et al. | 333/1 |
| 2010/0109816 | A1 * | 5/2010 | Tzuang et al. | 333/238 |

OTHER PUBLICATIONS

M. Chiang, H. Wu, C. C. Tzuang; Coupler Using Edge-Coupled Meandered Synthetic Transmission Lines; International Microwave Symposium; 2008 IEEE MTT-S; Atlanta, Georgia, Jun. 15-20, 2008.

* cited by examiner

*Primary Examiner* — Dean Takaoka
(74) *Attorney, Agent, or Firm* — WPAT, PC; Justin King

(57) ABSTRACT

This invention discloses a complementary-conducting-strip coupled-line (CCS CL). The CCS CL includes a substrate, m layers of mesh ground planes interlacing with m−1 layer(s) of first inter-media-dielectric (IMD) to form a stack structure on the substrate, a second IMD layer being on the stack structure, and n metal lines being on the second IMD layer and being edge-coupled with each other. Wherein, the m−1 first IMD layer(s) has(have) a plurality of vias to connect matching mesh ground planes, therein, m≧2 and m is a natural number, n≧2 and n is a natural number.

30 Claims, 11 Drawing Sheets

COMPLEMENTARY-CONDUCTING-STRIP COUPLED-LINE

BACKGROUND OF THE INVENTION

1. Field of the Invention

This invention generally relates to the field of coupled transmission line, and more particularly, to a complementary-conducting-strip coupled-line (thereinafter called CCS CL).

2. Description of the Prior Art

The thin-film microstrip (thereinafter called TFMS) is the most popular transmission line (thereinafter called TL) for realizing monolithic microwave integrated circuit (thereinafter called MMIC). When TFMS is designed for backward-wave couplers, however, the directivity is generally poor because the even- and odd-mode phase velocities of the coupled TFMSs are not equal. Furthermore, due to spacing limitation between edge-coupled TFMSs, which is restricted by the capability of the complementary metal-oxide semiconductor (thereinafter called CMOS) technology, limit the tight coupling achievable to about 3.0 dB over λg/4 sections. The broadside-coupled structures are often used and caused the super loss of TLs on the silicon or GaAs substrate with very thin layer of inter-media-dielectric (thereinafter called IMD).

In view of the drawbacks mentioned with the prior art of coupled TLs, there is a continuous need to develop a new and improved CCS CL that overcomes the shortages associated with the prior art. The advantages of the present invention are that it solves the problems mentioned above.

SUMMARY OF THE INVENTION

In accordance with the present invention, a CCS CL substantially obviates one or more of the problems resulted from the limitations and disadvantages of the prior art mentioned in the background.

One of the purposes of the present invention is to provide a variety of layers of mesh ground planes and of sizes of mesh slots thereof, whereby the even- and odd mode characters of the circuits synthesized by CCS CLs can be adjusted.

One of the purposes of the present invention is to offer a variety of widths of metal lines and of intervals thereof, whereby the even- and odd mode characters of the circuits combined by CCS CLs can be adjusted. The present invention provides a CCS Cl. The CCS CL includes a substrate, m layers of mesh ground planes interlacing with m−1 layer(s) of first IMD to form a stack structure on the substrate, a second IMD layer being on the stack structure, and n metals lines being on the second IMD layer and being edge-couple with each other. Wherein, the m−1 first IMD layer(s) has(have) a plurity of vias to connected matching mesh grounds planes, herein, m, n are natural numbers and m ≧2, n ≧.

The present invention offers a CCS CL. The CCS CL includes a substrate, a mesh ground plane being on the substrate, an IMD layer being on the mesh ground plane, and n metal lines being on the IMD layer and being edge-coupled with each other. Wherein, n is a natural number and n ≧2.

The present invention gives a CCS CL. The CCS CL includes a substrate, m layers of mesh ground planes interlacing with m−1 layer(s) of first IMD to form a stack structure on the substrate, a second IMD layer being on the stack structure, and n metal lines being above the second IMD layer and being broadside-coupled with each other. Wherein, the m−1 first IMD layer(s) has(have) a plurality of vias to connect matching mesh ground planes, and the n metal lines interlace with n−1 layer(s) of third IMD, herein, m, n are natural numbers and m ≧2,n ≧2.

The present invention provides a CCS CL. The CCS CL includes a substrate, a mesh ground plane being on the substrate, a first IMD layer being on the mesh ground plane, and n metal lines being above the first IMD layer and being broadside-coupled with each other. Wherein, the n metal lines interlace with n−1 layer(s) of second IMD, herein, n is a natural number and n ≧2.

The present invention offers a CCS CL. The CCS CL includes a substrate, m layers of mesh ground planes interlacing with m−1 layer(s) of first IMD layer(s) to form a stack structure on the substrate, a second IMD layer being on the stack structure, and y layers of metal lines interlacing with y−1 layer(s) of third IMD and being above the second IMD layer. Wherein, the m−1 first IMD layer(s) has(have) a plurality of vias to connect matching mesh ground planes, and the y metal line layers individually at least have n metal lines being edge-coupled with each other, herein, m, n, y are natural numbers and m ≧2, n ≧2, y ≧2.

The present invention gives a CCS CL. The CCS CL includes a substrate, a mesh ground plane being on the substrate, a first IMD layer being on the mesh ground plane, and y layers of metal lines interlacing with y−1 layer(s) of second IMD and being above the first IMD layer. Wherein, the y metal line layers individually at least have n metal lines being edge-coupled with each other, herein n, y are natural numbers and n ≧2, y ≧2.

BRIEF DESCRIPTION OF THE DRAWINGS

The accompanying drawings incorporated in and forming a part of the specification illustrate several aspects of the present invention, and together with the description serve to explain the principles of the disclosure. In the drawings.

DETAILED DESCRIPTION OF THE PREFERRED EMBODIMENTS

Some embodiments of the present invention will now be described in greater detail. Nevertheless, it should be noted that the present invention can be practiced in a wide range of other embodiments besides those explicitly described, and the scope of the present invention is expressly not limited except as specified in the accompanying claims.

Moreover, some irrelevant details are not drawn in order to make the illustrations concise and to provide a clear description for easily understanding the present invention.

Referring to FIGS. 1, 2, 3A, and 3B, the three-dimensional perspective structure, the top view, and the cross-sectional views from A-A', and B-B' cuts of one preferred embodiment 100 in accordance with the present invention are illustrated, correspondingly. Please refer to FIG. 1. A substrate 110 has the size of one periodicity P. m layers of mesh ground planes $M_1$, $M_2$, . . . , and $M_m$ interlace with m−1 layers of first inter-media-dielectric (thereinafter called IMD) $IMD_{12}$, $IMD_{23}$, . . . , and $IMD_{(m-1)m}$, that is, the first IMD layer $IMD_{12}$ is between the mesh ground planes $M_1$ and $M_2$, the first IMD layer $IMD_{23}$is between the mesh ground planes $M_2$ and $M_3$ (not shown), . . . , and the first IMD layer $IMD_{(m-1)m}$ is between the mesh ground planes $M_{(m-1)}$(not shown) and $M_m$, to form a stack structure 120 on the substrate 110. Herein, m is a natural number and m ≧2. In the present embodiment, each mesh ground plane, such as $M_1$, $M_2$, . . . , $M_m$, is a metal layer with an inner slot, and the size of the inner slot is defined by mesh slot $W_h$. A second IMD layer $IMD_T$ is on the stack structure 120. n metal lines $L_1$, $L_2$, . . . , and $L_n$ are edge-coupled with each other and are on the second IMD layer $IMD_T$. Herein, n is a natural number and n ≧2. The widths of the n metal lines $L_1$, $L_2$, . . . , $L_n$ refer to $S_1$, $S_2$, $S_n$, respectively, and $d_{12}$, $d_{23}$ (not shown), . . . , $d_{(n-1)n}$(not shown) denote the intervals of the n metal lines $L_1$, $L_2$, . . . , $L_n$, respectively. Herein, the n metal lines $L_1$, $L_2$, . . . , $L_n$ include straight-line form.

The inventor would likes to emphasize that the geometric shape for the substrate 110, the mesh ground planes $M_1$, $M_2$, . . . , $M_m$, the first IMD layers $IMD_{12}$, $IMD_{23}$, . . . , $IMD_{(m-1)m}$, and the second IMD layer $IMD_T$ can be variety, and should not be limited to the square shape shown in the present embodiment. The second IMD layer $IMD_T$ only shows one layer for simple explanation, however, the second IMD layer $IMD_T$ could be a multilayer structure in practices. Furthermore, the inner slots of the mesh ground planes $M_1$, $M_2$, . . . , $M_m$ are also filled with IMD material, and this part will not be repeated thereinafter.

Figure 1:
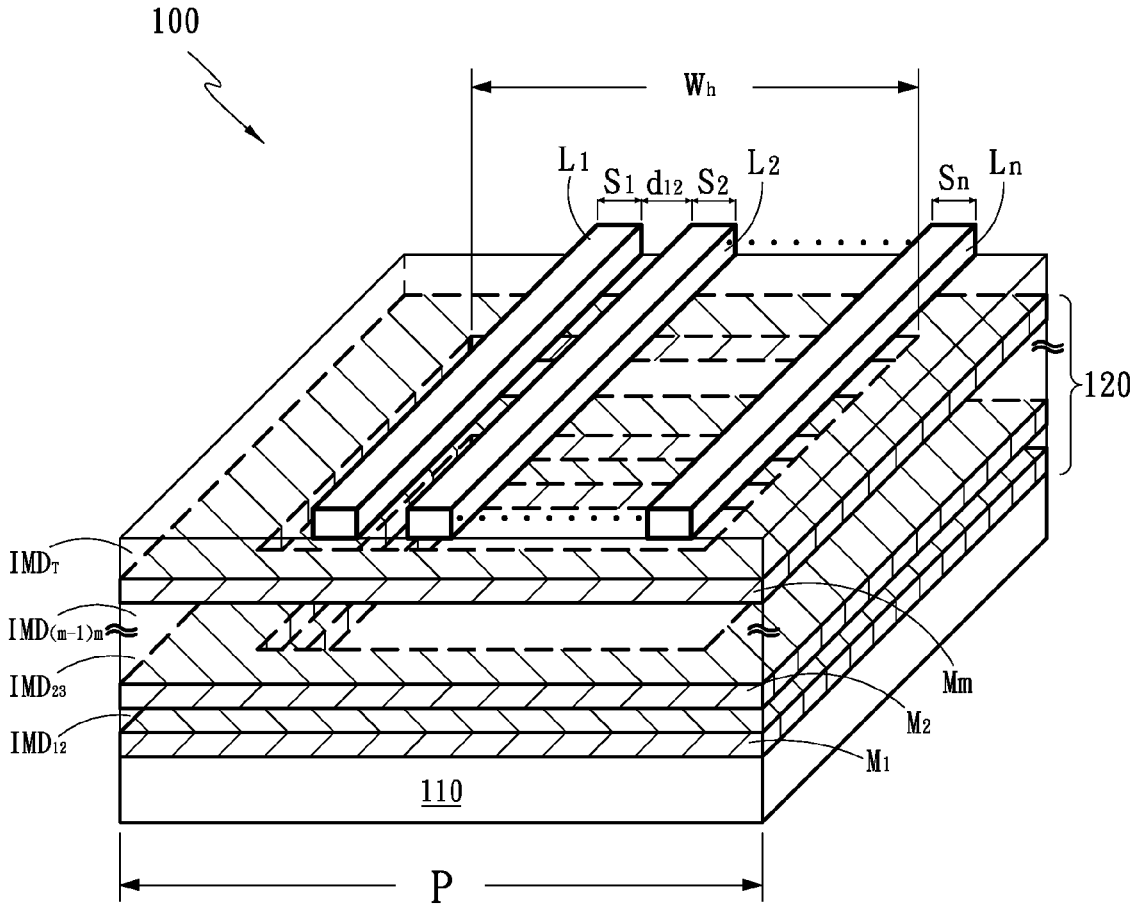
FIG. 1 illustrates the three-dimensional perspective structure of one preferred embodiment in accordance with the present invention.
Figure 2:
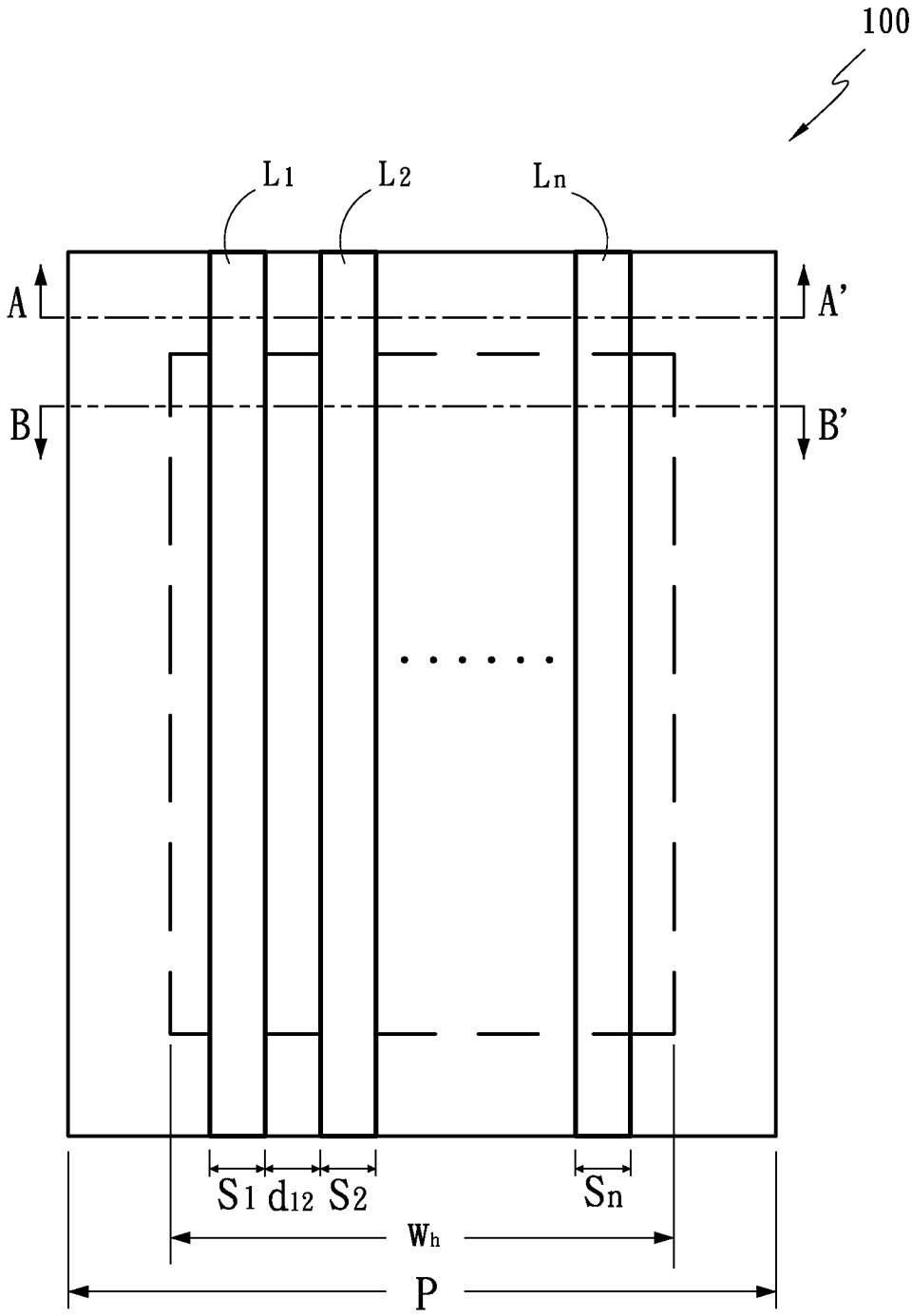
FIG. 2 depicts the top view of the embodiment shown in FIG. 1.

Referring to FIG. 2, the top view of the embodiment 100 shown in FIG. 1 is depicted. An A-A' cut and a B-B' cut make vertically cross-sectional views from the top of the mesh ground planes $M_1$, $M_2$, . . . , $M_m$ (referring to FIG. 1), and the top of the inner slots to the bottoms thereof, respectively. The denotations in FIG. 2 have the same meanings as those denoted in FIG. 1, thus they will not be described again here.

Figure 3A:
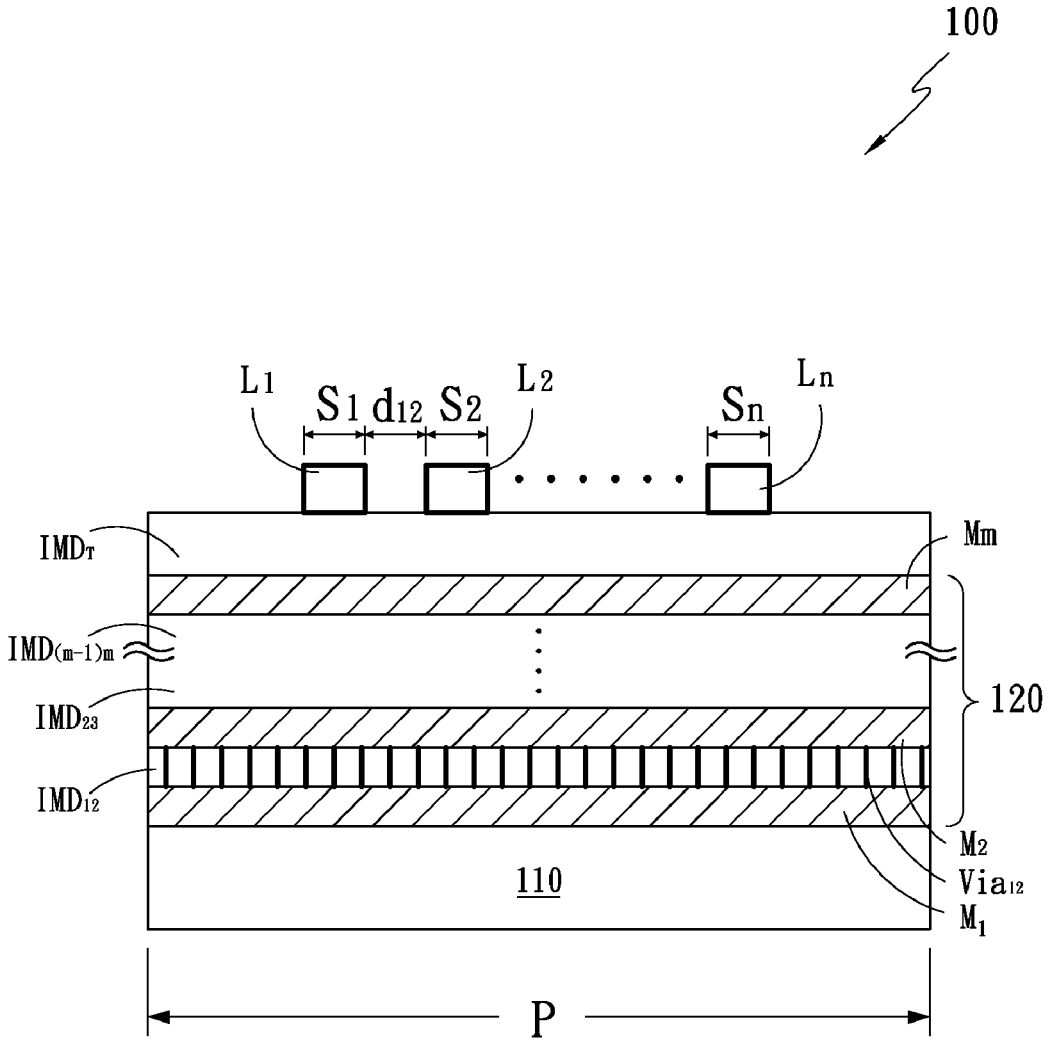
FIG. 3A depicts the cross-sectional view of the embodiment shown in FIG. 2 from A-A' cut.
Figure 3B:
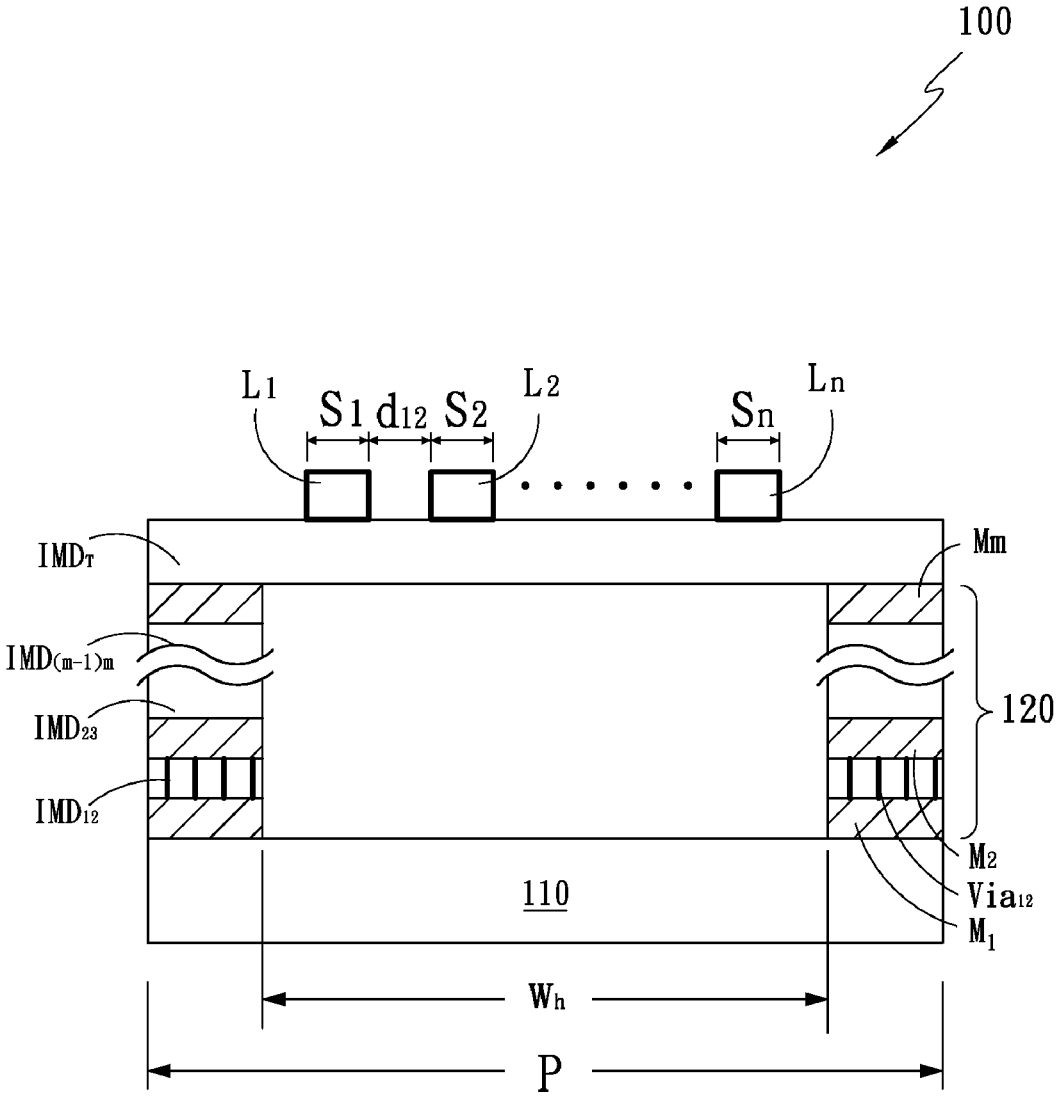
FIG. 3B depicts the cross-sectional view of the embodiment shown in FIG. 2 from B-B' cut.

Referring to FIGS. 3A and 3B, the cross-sectional views of the embodiment shown in FIG. 2 from A-A', B-B' cuts are respectively depicted. m−1 first IMD layers $IMD_{12}$, $IMD_{23}$, . . . , $IMD_{(m-1)m}$ have a plurality of vias to connect matching m layers of mesh ground planes. For example, the first IMD layer $IMD_{12}$ has a plurality of vias $via_{12}$ to connect the mesh ground planes $M_1$ and $M_2$. The size of the inner slot of the stack structure 120 is defined by mesh slot $W_h$. However, the stack structure 120 behind the inner slot in FIG. 3B is not depicted in order to stress the inner slot decided by mesh slot $W_h$ and make FIG. 3B clear. The other denotations have the same meanings as those denoted in FIG. 1, thus they will not be described again here.

Figure 4:
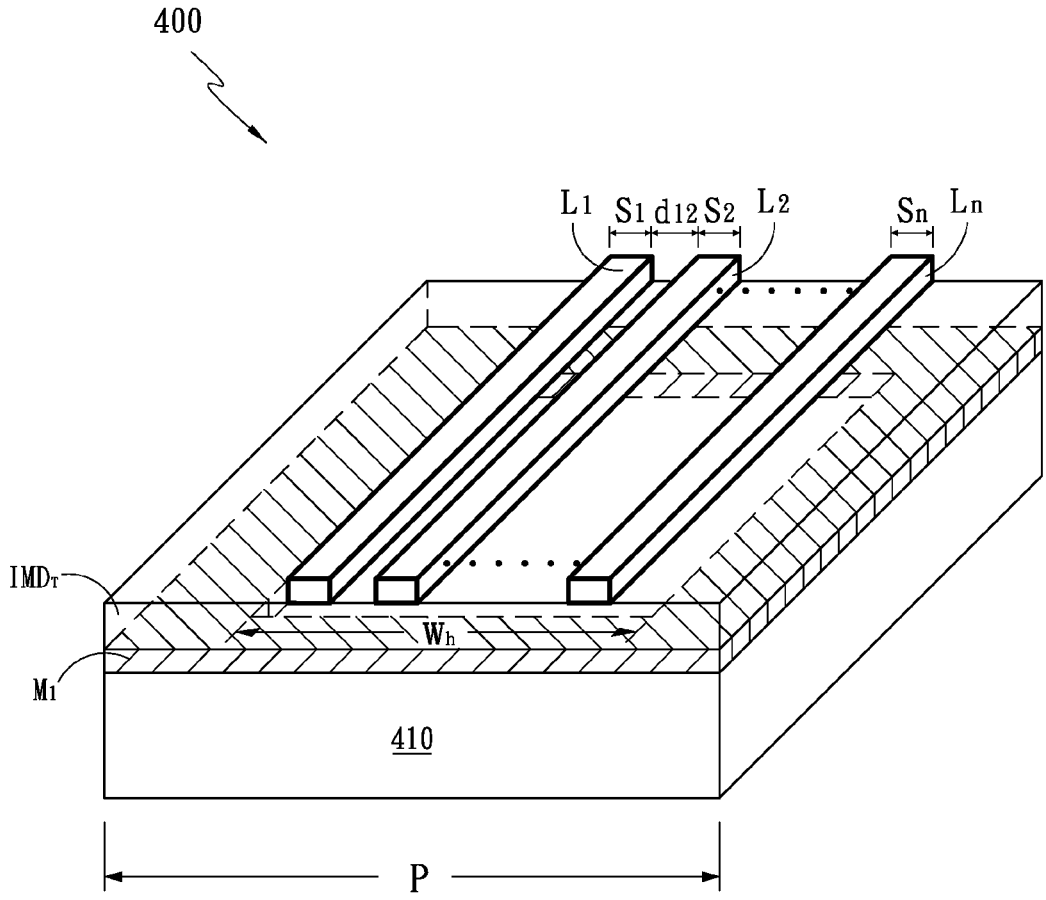
FIG. 4 illustrates the three-dimensional perspective structure of another preferred embodiment in accordance with the present invention.

Referring to FIG. 4, a three-dimensional perspective structure for another preferred embodiment 400 in accordance with the present invention is illustrated. A substrate 410 has the size of one periodicity P. A mesh ground plane $M_1$ is on the substrate 410, herein, the mesh ground plane $M_1$ is a metal layer with an inner slot, and the size of the inner slot is defined by mesh slot $W_h$. An IMD layer $IMD_T$ is on the mesh ground plane $M_1$. n metal lines $L_1$, $L_2$, . . . , and $L_n$ are edge-coupled with each other and are on the IMD layer $IMD_T$. Herein, n is a natural number and n ≧2. The widths of the n metal lines $L_1$, $L_2$, . . . , $L_n$ refer to $S_1$, $S_2$, . . . , $S_n$, respectively, and $d_{12}$, $d_{23}$ (not shown), . . . , $d_{(n-1)n}$ (not shown) denote the intervals of the n metal lines $L_1$, $L_2$, . . . , $L_n$, respectively. Herein, the n metal lines $L_1$, $L_2$, . . . , $L_n$ include straight-line form.

Figure 5:
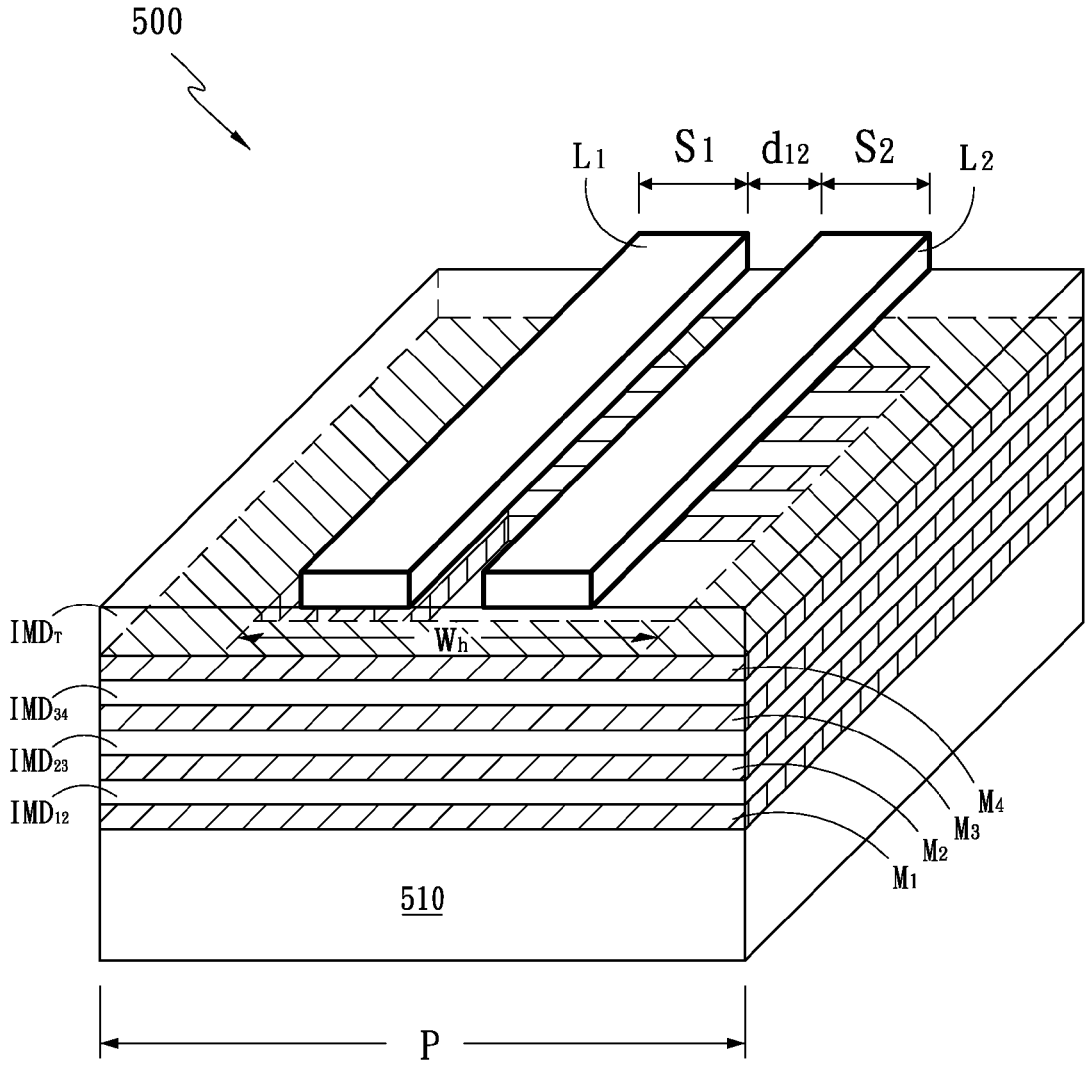
FIG. 5 illustrates the three-dimensional perspective structure of further another preferred embodiment in accordance with the present invention.

Referring to FIG. 5, a three-dimensional perspective structure for further another preferred embodiment 500 in accordance with the present invention is illustrated. Herein, FIG. 5 illustrates the embodiment 100 shown in FIG. 1 in case of m=4 and n=2. The explanation will be simply described as below. A substrate 510 has the size of one periodicity P. 4 mesh ground planes $M_1$, $M_2$, $M_3$, $M_4$ interlace with 3 first IMD layers $IMD_{12}$, $IMD_{23}$, $IMD_{34}$ to form a stack structure on the substrate 510. Herein, the mesh ground planes $M_1$, $M_2$, $M_3$, $M_4$ are metal layers with inner slots, and the size of the inner slot is defined by mesh slot $W_h$. A second IMD layer $IMD_T$ is on the stack structure. 2 metal lines $L_1$, $L_2$ are edge-coupled with each other and are on the second IMD layer $IMD_T$. The widths of the metal lines $L_1$, $L_2$ refer to $S_1$, $S_2$, respectively, and $d_{12}$ denotes the interval of the metal lines $L_1$, $L_2$. Similarly, the first IMD layers $IMD_{12}$, $IMD_{23}$, $IMD_{34}$ have a plurality of vias to connect matching mesh ground planes $M_1$-$M_2$, $M_2$-$M_3$, $M_3$-$M_4$.

Figure 6A:
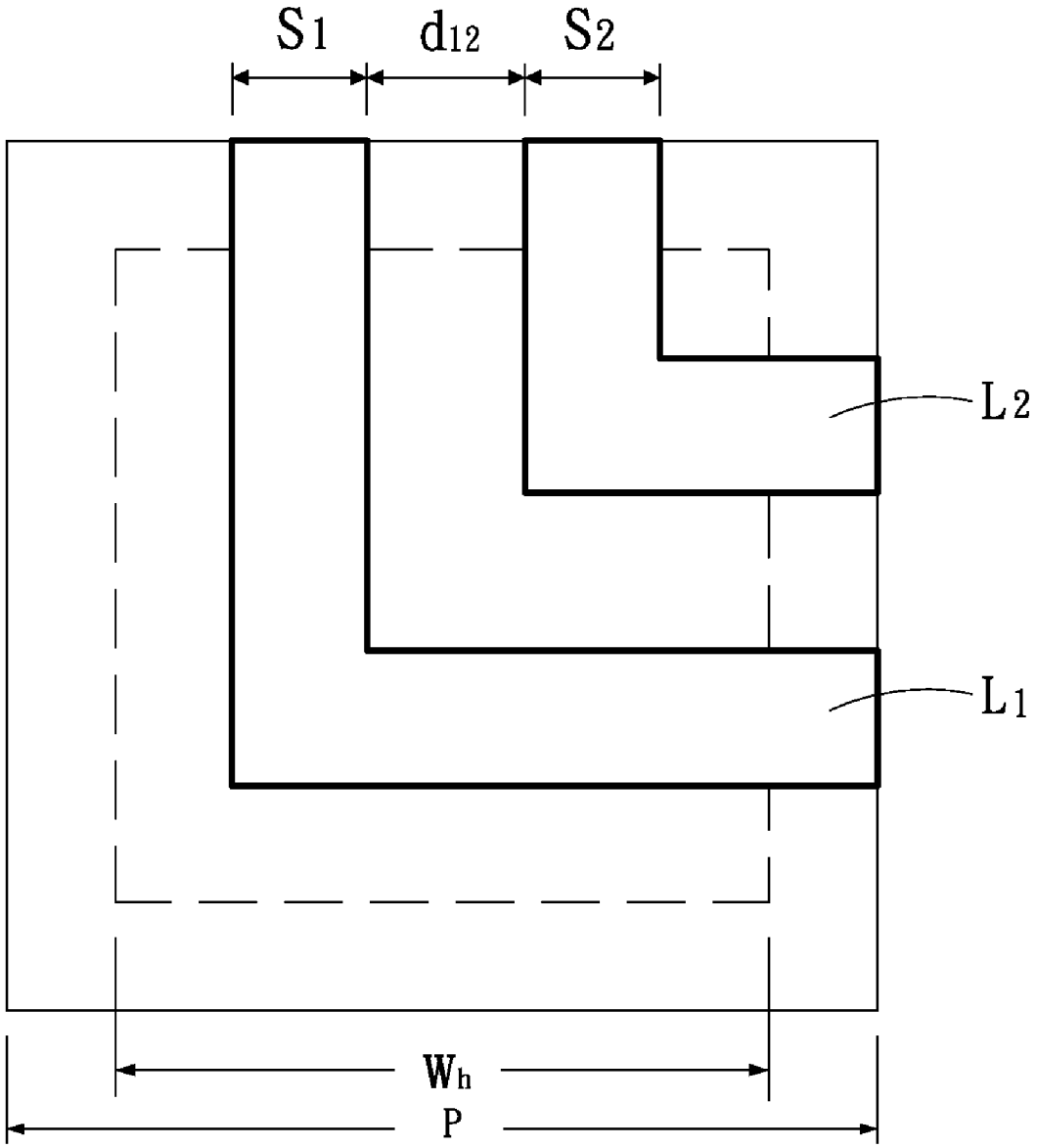
FIG. 6A shows the top view of one preferred edge-coupled embodiment in accordance with the present invention.
Figure 6B:
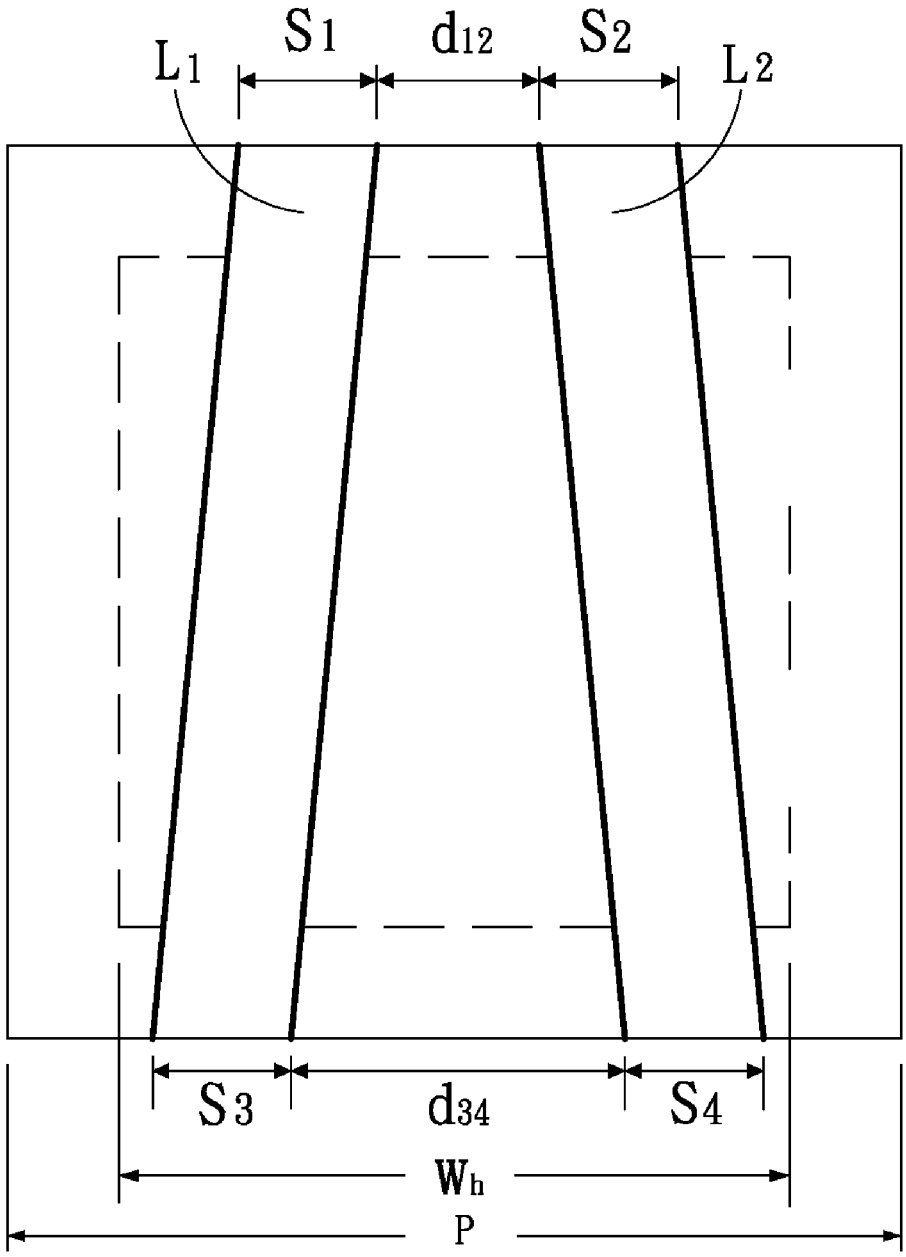
FIG. 6B shows the top view for another preferred edge-coupled embodiment in accordance with the present invention.

Referring to FIG. 6A, a top view of one preferred edge-coupled embodiment in accordance with the present invention is shown. 2 metal lines $L_1$, $L_2$ are parallel and show L form. Herein, $S_1$, $S_2$ respectively denote the widths of the metal lines $L_1$, $L_2$, and $d_{12}$ denotes the interval of the metal lines $L_1$, $L_2$. Referring to FIG. 6B, a top view for another preferred edge-coupled embodiment in accordance with the present invention is shown. 2 metal lines $L_1$, $L_2$ are edge-coupled in a non-parallel way. That is, the interval $d_{12}$ of the metal lines $L_1$, $L_2$ at one side is not equal to the interval $d_{34}$ of the metal lines $L_1$, $L_2$ at the other side. Herein, $S_1$, $S_2$ respectively denote the widths of the metal lines $L_1$, $L_2$. In the two abovementioned embodiments, the n metal lines are described in case of n=2 for simple explanation, but not limit to. As n is bigger than 2, however, the n metal lines could also be parallel in L form or be edge-coupled in non-parallel ways. P denoting periodicity and $W_h$ denoting the size of mesh slot are the same as those mentioned above, moreover, the coupling ways shown in the two embodiments can be applied to the embodiments in accordance with the present invention.

Figure 7A:
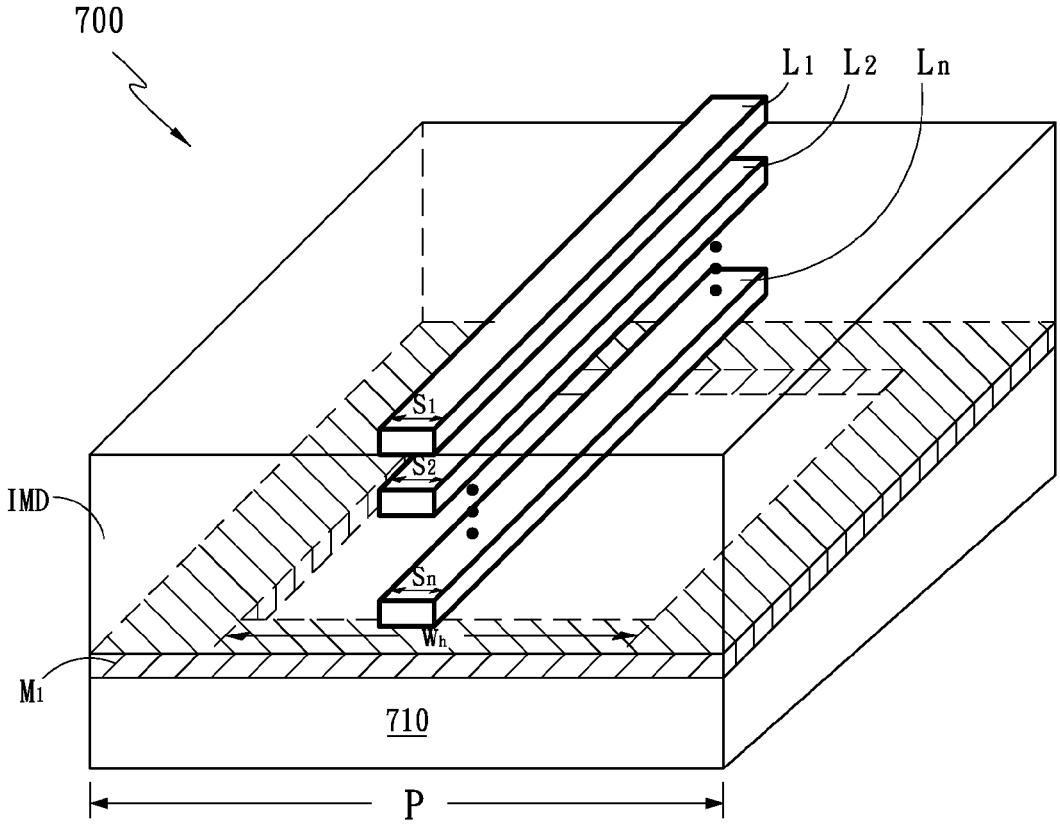
FIG. 7A illustrates the three-dimensional perspective structure of still another preferred embodiment in accordance with the present invention.

Referring to FIG. 7A, the three-dimensional perspective structure for still another preferred embodiment 700 in accordance with the present invention is illustrated. A substrate 710 has the size of one periodicity P. A mesh ground planes $M_1$ with an inner slot in size of mesh slot $W_h$is on the substrate 710. A first IMD layer $IMD_1$ is on the mesh ground planes $M_1$.

n metal lines $L_{1, L2}, \ldots, L_n$ are broadside-coupled with each other and are above the first IMD layer $IMD_1$. Herein, the n metal lines $L_1, L_2, \ldots, L_n$ interlace with n−1 second IMD layers $IMD_2$, where n is a natural number and n ≧2. $S_1, S_2, \ldots, S_n$ denote the widths of the metal lines $L_1, L_2, \ldots, L_n$, respectively. Also, the mesh ground plane in the present invention could be a multilayer structure, such as those shown in FIGS. 1, 3A and 3B. And this part can be obvious to those skilled in the art after realizing the disclosure of the present invention, thus it will not be described in detail. However, what is explained here is that if the IMD layers between the mesh ground planes are called first IMD layers, the IMD layer between the mesh ground plane and the metal line and the IMD layers between the metal lines are called second IMD layer and third IMD layers, respectively, in order to identify their related positions.

Figure 7B:
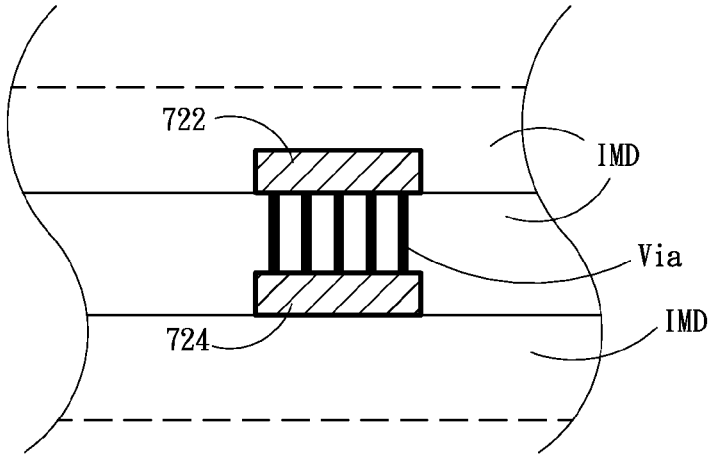
FIG. 7B illustrates the cross-sectional view of one preferred metal line embodiment in accordance with the present invention.

Referring to FIG. 7B, the cross-sectional view of one preferred metal line embodiment in accordance with the present invention is illustrated. A metal line includes two sub-metal-lines 722, 724 and a plurality of vias via. The two sub-metal-lines 722, 724 are two metal transmission lines on different layers in a CMOS structure. They are connected by the plurality of vias via to form the metal line and to increase the thickness of the metal line in the CMOS structure. IMD denotes IMD layer. The present embodiment can be applied to the metal lines of the embodiments in accordance with the present invention to adjust the character of metal lines.

To integrate the abovementioned preferred embodiments, the present invention also can be implemented by two following preferred embodiments. That is, metal lines can be edge-coupled and broadside-coupled simultaneously with single layer or multilayer of mesh ground plane(s). The structures will be described as below. One complementary-conducting-strip coupled-line (thereinafter called CCS CL) includes a substrate, m layers of mesh ground planes interlacing with m−1 first IMD layer(s) to form a stack structure on the substrate, a second IMD layer being on the stack structure, and y layers of metal lines interlacing with y−1 third IMD layer(s) and being above the second IMD layer. Wherein, the m−1 first IMD layer(s) has(have) a plurality of vias to connect matching mesh ground planes, and the y metal line layers individually at least have n metal lines being edge-coupled with each other, herein, m, n, y are natural numbers and m ≧2, n ≧2, y ≧2. Further, the n metal lines on the two adjacent y metal line layers are broadside-coupled with each other. The other CCS CL includes a substrate, a mesh ground plane being on the substrate, a first IMD layer being on the mesh ground plane, and y layers of metal lines interlacing with y-1 second IMD layer(s) and being above the first IMD layer. Wherein, the y metal line layers individually at least have n metal lines being edge-coupled with each other, herein, n, y are natural numbers and n ≧2, y ≧2. Further, the n metal lines on the two adjacent y metal line layers are broadside-coupled with each other.

Figure 8A:
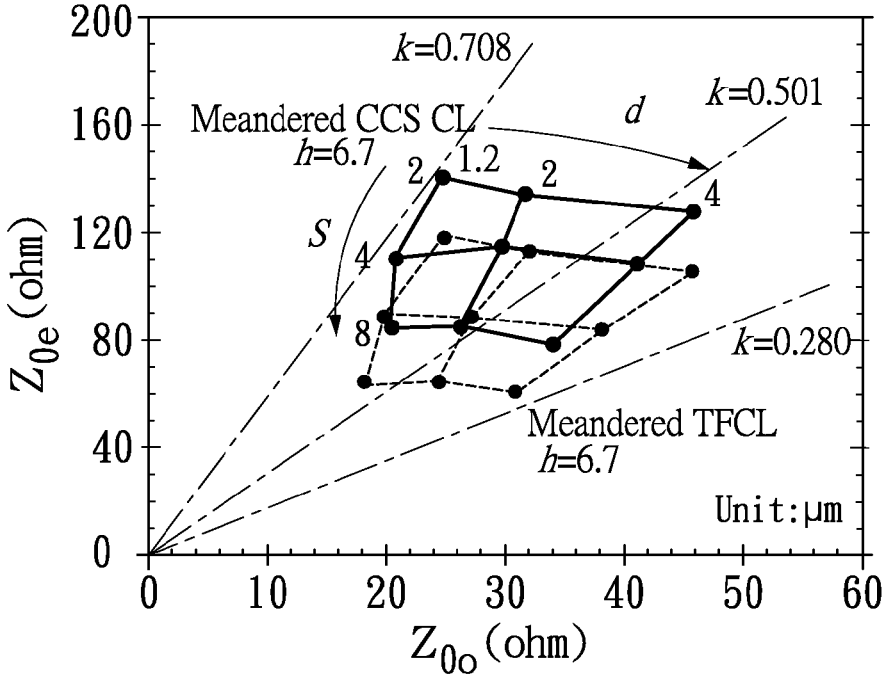
FIG. 8A shows the extracted result of $Z_{0e}$ and $Z_{0o}$ by varying the size of mesh slot of mesh ground plane with different widths and intervals of metal lines for the embodiments in accordance with the present invention.
Figure 8B:
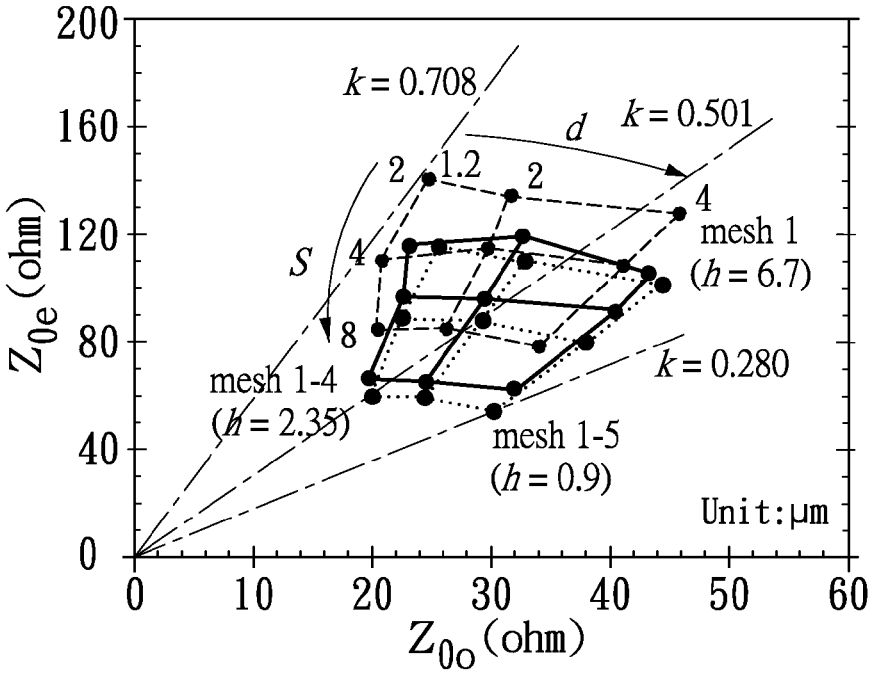
FIG. 8B shows the extracted result of $Z_{0e}$ and $Z_{0o}$ by varying the number of mesh ground with fixed size of mesh slot of mesh ground plane for the embodiments in accordance with the present invention.

Referring to FIGS. 8A and 8B, an extracted result of even- and odd-mode characteristic impedances ($Z_{0e}$ and $Z_{0o}$) by varying the size of mesh slot ($W_h$) of mesh ground plane with different widths (S) and intervals (d) of metal lines for the embodiments in accordance with the present invention and an extracted result of even- and odd-mode characteristic impedances ($Z_{0e}$ and $Z_{0o}$) by varying the number (m) of mesh ground with fixed size of mesh slot ($W_h$) of mesh ground plane for the embodiments in accordance with the present invention are shown, respectively. The inventor would like to emphasize here is that the related data set for simulations and the results obtained from simulations are used to explain the simulation processes and the results of preferred embodiments in accordance with the present invention, but not limit the implementing of the present invention. Taking the embodiments 400 and 500 respectively shown in FIGS. 4 and 5 for simulation explanations, a plurality of embodiments 400 (n=2) and embodiments 500 respectively integrate the edge-coupled embodiment (one layer and four layers of mesh ground plane(s)) shown in FIG. 6 to form two two-dimensional array structures with meandered edge-coupled metal lines, correspondingly, to scale down the circuit size.

The data set for simulations is defined as below. The total length of the metal line is fixed and defined as 960.0 μm. The thickness and resistivity of the top metal line are 2.3 μm and 37 mΩ/sq, respectively. The widths (S) of the metal line are respectively 2.0 μm, 4.0 μm, 8.0 μm. The intervals (d) of the metal lines are respectively 1.2 μm, 2.0 μm, 4.0 μm. The thickness and resistivity of the other layers are 0.55 μm and 79 mΩ/sq, respectively. The mesh slots ($W_h$) are 29.5 μm and 0 μm, respectively. The relative dielectric constants of the IMD and the substrate are 4.0 and 11.9, respectively. The thickness and conductivity of the substrate are 482.6 μm and 11.0 S/m, respectively. Moreover, the simulations are performed by the commercial software package Ansoft HFSS, and the results obtained from the simulations are shown in TABLE 1, FIGS. 8A, and 8B, respectively.

Referring to TABLE 1, the even- and odd-mode Q-factors can be adjusted by varying the width (S) of metal line, the interval (d) of metal line, the size of mesh slot ($W_h$), and the number (m) of mesh ground plane in order to provide more flexible for users to synthesize expected conducting characters. Wherein, $Z_{0e}$ and $Z_{0o}$ represent the real parts of the even- and odd-mode characteristics impedances, respectively. K is defined by the ratio of the sum of $Z_{0e}$ and $Z_{0o}$ to the difference of $Z_{0e}$ and $Z_{0o}$. The slow-wave factors of even- and odd-mode, which are denoted by $SWF_e$ and $SWF_o$, are defined as the normalized phase constant ($\beta_e/k_0$ and 62 $_o/k_0$) of the complementary-conducting-strip coupled-line. The Q-factors of even- and odd-mode, which are denoted by $Q_e$ and $Q_o$, are the ratio of the phase constant to the twice of the attenuation constant. The minimum values of the line width (S) and interval (d), which are 2.0 μm and 1.2 μm, are defined by the foundry rules, revealing the process-limits on the CCS CL syntheses. Additionally, TABLE 1 shows two portions of CCS CL syntheses. When $W_h$=0, the CCS CL is regarded as the conventional thin-film coupled-line (thereinafter called TFCL), forming the special limiting case of the CCS CL designs. In this type of designs, the metal line and ground plane are only realized by the $M_6$ and $M_1$, respectively, in the standard 0.18-μm 1P6M CMOS technology. The extracted results show the maximum and minimum values of the $Z_{0e}$ and $Z_{0o}$ are 117.6Ω and 24.8Ω, resulting in the maximum K of 0.65. All the extracted results from the syntheses of the TFCL show the values of $SWF_e$ are lower than those of $SWF_o$. When line width (S) and line interval (d) are set as 2.0 μm and 1.2 μm, the difference between $SWF_e$ and $SWF_o$ has a maximum value of 0.58. The minimum difference between $SWF_e$ and $SWF_o$ is 0.32 when line width (S) and line interval (d) are set as 8.0 μm and 4.0 μm. The guiding properties summarized above follow the conventional characteristics of the TFCL. However, the CCS CL, which has more structural parameters than those of the conventional TFCL, can have much more degree of freedom on coupled-line syntheses.

TABLE 1

The coupled-line designs of the CCS CLs with the same periodicity (P) of 30.0 μm for discussions of quality factors (Q-factors) of even- and odd-mode at Ka-band

| Type | S (μm) | d (μm) | $W_h$ (μm) | Metal Layer | $Z_{0e}$ (Ω) | $Z_{0o}$ (Ω) | K | $SWF_e$ | $SWF_o$ | $Q_e$ | $Q_o$ |
|---|---|---|---|---|---|---|---|---|---|---|---|
| CCS | 2.0 | 1.2 | 29.5 | $M_1$ | 139.8 | 24.7 | 0.70 | 1.83 | 2.36 | 7.08 | 3.05 |
| CL | 4.0 | 1.2 | 29.5 | $M_1$ | 109.6 | 20.8 | 0.68 | 1.80 | 2.34 | 7.00 | 3.35 |
| ($W_h \neq 0$) | 8.0 | 1.2 | 29.5 | $M_1$ | 84.4 | 20.4 | 0.61 | 1.67 | 2.21 | 5.86 | 4.00 |
| | 2.0 | 2.0 | 29.5 | $M_1$ | 133.9 | 31.8 | 0.62 | 1.83 | 2.21 | 7.01 | 3.93 |
| | 4.0 | 2.0 | 29.5 | $M_1$ | 114.2 | 29.7 | 0.59 | 1.76 | 2.14 | 6.88 | 4.67 |
| | 8.0 | 2.0 | 29.5 | $M_1$ | 84.7 | 26.2 | 0.53 | 1.64 | 2.04 | 5.85 | 5.40 |
| | 2.0 | 4.0 | 29.5 | $M_1$ | 127.0 | 45.9 | 0.47 | 1.80 | 2.04 | 6.70 | 5.46 |
| | 4.0 | 4.0 | 29.5 | $M_1$ | 107.9 | 41.1 | 0.45 | 1.73 | 1.97 | 6.59 | 6.58 |
| | 8.0 | 4.0 | 29.5 | $M_1$ | 78.3 | 34.0 | 0.39 | 1.62 | 1.87 | 5.60 | 7.31 |
| | 2.0 | 1.2 | 29.5 | $M_1$~$M_4$ | 115.4 | 23.1 | 0.67 | 2.04 | 2.39 | 9.62 | 2.94 |
| | 4.0 | 1.2 | 29.5 | $M_1$~$M_4$ | 96.3 | 22.5 | 0.62 | 2.00 | 2.32 | 10.4 | 3.51 |
| | 8.0 | 1.2 | 29.5 | $M_1$~$M_4$ | 66.6 | 19.6 | 0.54 | 1.91 | 2.25 | 9.40 | 4.01 |
| | 2.0 | 2.0 | 29.5 | $M_1$~$M_4$ | 118.8 | 32.6 | 0.57 | 2.00 | 2.21 | 9.62 | 3.95 |
| | 4.0 | 2.0 | 29.5 | $M_1$~$M_4$ | 95.9 | 29.3 | 0.53 | 1.98 | 2.16 | 10.3 | 4.71 |
| | 8.0 | 2.0 | 29.5 | $M_1$~$M_4$ | 65.2 | 24.4 | 0.46 | 1.90 | 2.11 | 9.32 | 5.39 |
| | 2.0 | 4.0 | 29.5 | $M_1$~$M_4$ | 105.0 | 43.6 | 0.42 | 2.02 | 2.09 | 9.32 | 5.43 |
| | 4.0 | 4.0 | 29.5 | $M_1$~$M_4$ | 91.2 | 40.6 | 0.38 | 1.95 | 2.02 | 10.0 | 6.73 |
| | 8.0 | 4.0 | 29.5 | $M_1$~$M_4$ | 62.1 | 32.7 | 0.32 | 1.86 | 1.96 | 9.08 | 7.70 |
| | 8.0 | 6.0 | 29.5 | $M_1$~$M_4$ | 58.7 | 36.5 | 0.23 | 1.82 | 1.89 | 8.61 | 8.67 |
| | 2.0 | 1.2 | 29.5 | $M_1$~$M_5$ | 114.8 | 25.5 | 0.64 | 2.16 | 2.36 | 9.83 | 3.08 |
| | 4.0 | 1.2 | 29.5 | $M_1$~$M_5$ | 88.7 | 22.5 | 0.60 | 2.16 | 2.34 | 10.67 | 3.51 |
| | 8.0 | 1.2 | 29.5 | $M_1$~$M_5$ | 59.7 | 19.9 | 0.50 | 2.14 | 2.29 | 9.51 | 4.19 |
| | 2.0 | 2.0 | 29.5 | $M_1$~$M_5$ | 110.1 | 32.8 | 0.54 | 2.16 | 2.23 | 9.82 | 3.97 |
| | 4.0 | 2.0 | 29.5 | $M_1$~$M_5$ | 87.8 | 29.3 | 0.50 | 2.16 | 2.20 | 10.68 | 4.75 |
| | 8.0 | 2.0 | 29.5 | $M_1$~$M_5$ | 59.1 | 24.4 | 0.42 | 2.11 | 2.17 | 9.71 | 5.54 |
| | 2.0 | 4.0 | 29.5 | $M_1$~$M_5$ | 100.4 | 44.4 | 0.39 | 2.15 | 2.12 | 9.55 | 5.41 |
| | 4.0 | 4.0 | 29.5 | $M_1$~$M_5$ | 79.8 | 37.9 | 0.36 | 2.15 | 2.10 | 10.34 | 6.60 |
| | 8.0 | 4.0 | 29.5 | $M_1$~$M_5$ | 54.0 | 30.2 | 0.28 | 2.10 | 2.07 | 9.19 | 7.63 |
| CCS | 2.0 | 1.2 | 0 | $M_1$ | 117.6 | 24.8 | 0.65 | 1.77 | 2.35 | 9.22 | 3.06 |
| CL | 4.0 | 1.2 | 0 | $M_1$ | 88.6 | 19.7 | 0.64 | 1.72 | 2.35 | 10.3 | 3.32 |
| ($W_h = 0$) | 8.0 | 1.2 | 0 | $M_1$ | 64.2 | 18.2 | 0.56 | 1.59 | 2.23 | 10.4 | 3.88 |
| or | 2.0 | 2.0 | 0 | $M_1$ | 112.7 | 31.9 | 0.56 | 1.76 | 2.20 | 9.21 | 3.93 |
| TFCL | 4.0 | 2.0 | 0 | $M_1$ | 88.3 | 27.1 | 0.53 | 1.71 | 2.16 | 10.4 | 4.53 |
| | 8.0 | 2.0 | 0 | $M_1$ | 64.4 | 24.4 | 0.45 | 1.58 | 2.03 | 10.7 | 5.49 |
| | 2.0 | 4.0 | 0 | $M_1$ | 104.9 | 45.8 | 0.39 | 1.74 | 2.04 | 8.90 | 5.45 |
| | 4.0 | 4.0 | 0 | $M_1$ | 83.5 | 38.2 | 0.37 | 1.69 | 1.98 | 10.2 | 6.51 |
| | 8.0 | 4.0 | 0 | $M_1$ | 60.4 | 30.9 | 0.32 | 1.55 | 1.87 | 10.4 | 7.53 |

Referring to FIG. 8A, the dash-dot lines represent K of the coupled-lines. When the line width (S) increases from 2.0 μm to 8.0 μm and the line interval (d) increases from 1.2 μm to 4.0 μm, the values of $Z_{0e}$ and $Z_{0o}$ are changed, showing the following attributes. The dash curve represents the TFCL. $Z_{0e}$ of TFCL increases from 104.9Ω to 117.6Ω when the line width (S) is fixed as 2.0 μm and line interval (d) decreased from 4.0 μm to 1.2 μm. $Z_{0o}$ decreases from 45.8Ω to 24.8Ω. The maximum K of TFCL is 0.65. On the other hand, the solid curve represents the CCS CL with $W_h$ of 29.5 μm. The maximum and minimum values of $Z_{0e}$ are 139.8Ω and 78.3Ω, respectively. The maximum and minimum values of $Z_{0o}$ are 45.9Ω and 20.4Ω, respectively. Therefore, the maximum K of the CCS CL is 0.7. The comparisons between the solid and dash curves show that the CCS CL can improve the K of 7.7% with the identical line width (S) and line interval (d) to those of the TFCL. Wherein, h represents the thickness of the IMD between the top metal line and the mesh ground plane. Referring to FIG. 8B, the comparisons between the dash and dot curves show that K of the CCS CL can be controlled by only adjusting the thickness of the mesh ground plane (that is, the number of the mesh ground plane). When h increases from 0.9 μm to 6.7 μm, K increases from 0.28 to 0.7. FIG. 8B shows the CCS CL can achieve wider range of K than that of the TFCL. Wherein, the dash, solid, and dot curves representing the number of mesh ground plane are 1, 4, and 5, respectively. The thickness (h) of the IMD between the top metal line and the mesh ground plane get smaller as the number of mesh ground plane increases.

Figure 9A:
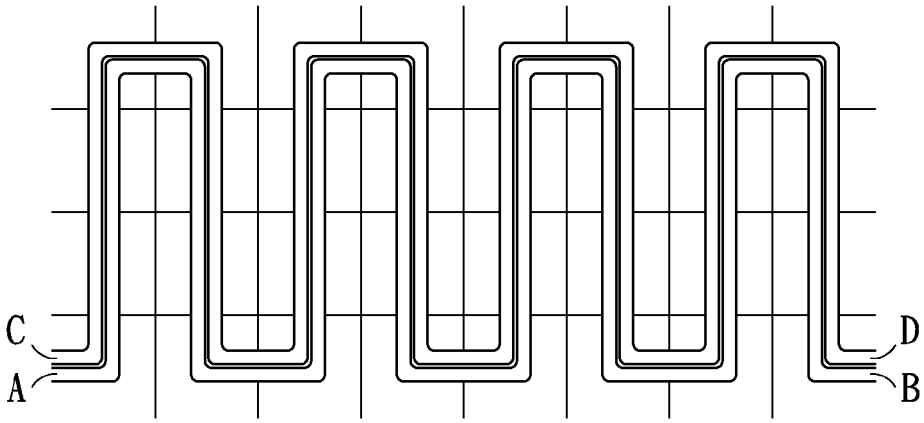
FIG. 9A depicts the layout of one preferred application circuit combined by several preferred embodiments in accordance with the present invention.
Figure 9B:
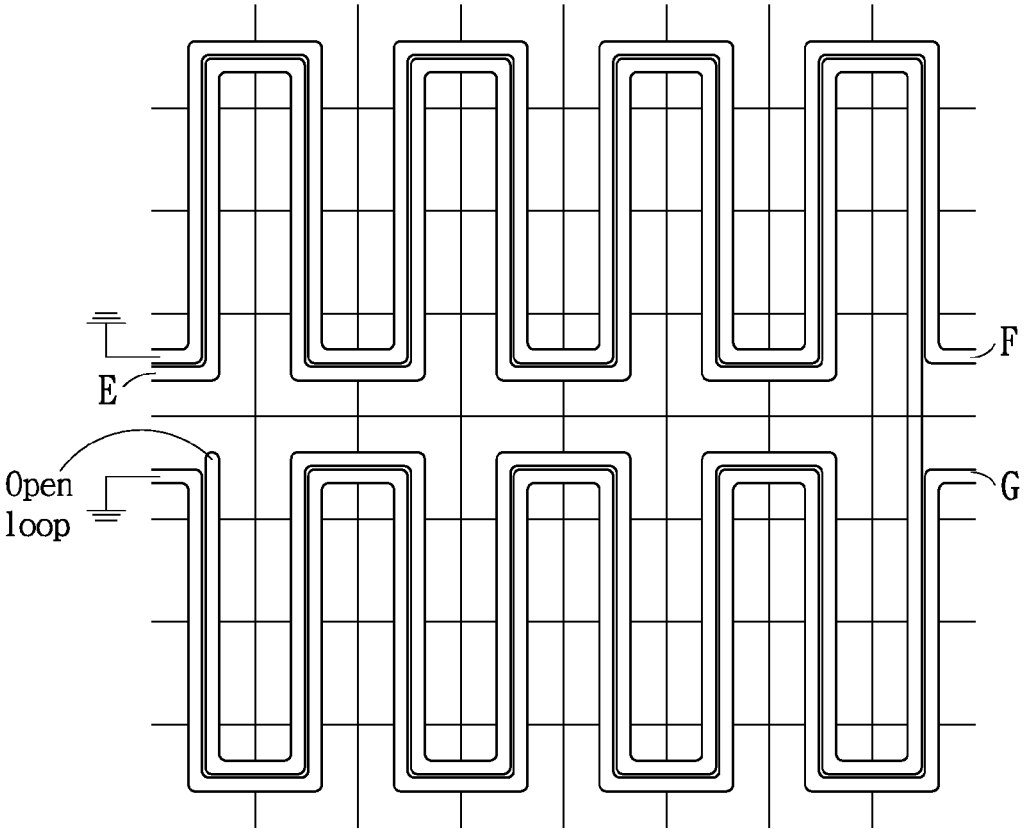
FIG. 9B depicts the layout of another preferred application circuit combined by several preferred embodiments in accordance with the present invention.

Referring to FIGS. 9A and 9B, the circuit layouts of 3-dB directional coupler and marchand balun following the designing principle of ¼ conducting wave (λg) respectively combine several preferred embodiments in accordance with the present invention to form two two-dimensional array structures with two meandered edge-coupled metal lines. The inventor would like to stress here is that the 3-dB directional coupler and the marchand balun designed by coupled metal lines, the total length of the coupled metal lines thereof follow the principle of ¼ λg, but not limit their meandering form. Referring to FIG. 9A, a first, a second, a third, and a fourth ends of a 3-dB directional coupler are denoted A, B, C, and D, respectively. Referring to FIG. 9B, a first, a second, and a third ends of a marchand balun are defined as E, F, and G, respectively. The areas of the 3-dB directional coupler and the marchand balun are 120.0 μm×240.0 μm and 240.0 μm×240.0 μm, respectively, and are fabricated by the standard 0.18-μm 1P6M CMOS technology, herein, the total length of the metal lines of the 3-dB directional coupler is 960.0 μm. TABLEs 2 and 3 respectively show the comparisons of different 3-dB directional couplers and the comparisons of different marchand baluns.

TABLE 2

The comparisons of different 3-dB directional couplers, herein, FOM = $f_{ave}$(GHz) × Area(mm$^2$), $f_{ave}$ = sqrt($f_{min}$ × $f_{max}$)

| Technology | Operating Frequency (GHz) | Loss (dB) | Approach | Size (mm$^2$) | FOM |
|---|---|---|---|---|---|
| SiGe | 52.5-67.5 | 4.5 | Lange | 0.019 | 1.13 |
| GaAs | 30.0-90.0 | 3.5 | Tandem | 0.227 | 9.63 |
| GaAs | 20.0-30.0 | 5.0 | Broadside | 0.040 | 0.98 |
| GaAs | 18.0-22.0 | 3.8 | Broadside | 0.640 | 12.7 |
| GaAs | 12.0-32.0 | 4.1 | Broadside | 1.027 | 20.1 |
| GaAs | 10.0-17.5 | 4.2 | Broadside | 1.080 | 14.3 |
| CMOS | 25.0-35.0 | 3.4 | Broadside Lange | 0.040 | 1.18 |
| CMOS | 14.2-36.9 | 4.4 | Edge-coupled | 0.029 | 0.66 |

TABLE 3

The comparisons of different marchand baluns, herein, FOM = $f_{ave}$(GHz) × Area(mm$^2$), $f_{ave}$ = sqrt($f_{min}$ × $f_{max}$)

| Technology | Size (mm$^2$) | Bandwidth (GHz) | Approach | FOM |
|---|---|---|---|---|
| CMOS | 0.06 | 16.5-67.0 | Asymmetric Broadside Coupled | 1.99 |
| CMOS | 0.55 | 25.0-65.0 | Multilayer | 22.1 |
| Raytheon's standard MMC-04 process | 2.0 | 7.0-19.0 | Multiconductor | 23.1 |
| GaAs | 0.05 | 21.0-41.0 | Multiconductor | 1.46 |
| GaAs | 0.10 | 10.0-25.0 | Transformer Type | 1.58 |
| SiGe | 0.13 | 2.5-12.0 | Transformer Type Lumped-Element | 0.71 |
| GaAs | 0.26 | 14.0-28.0 | Multilayer Spiral-Shaped Structure | 5.14 |
| SiGe | 0.17 | 12.0 | Transformer Type | 2.04 |
| CMOS | 0.12 | 25.0-50.0 | 3-D Transformer Type | 4.24 |
| CMOS | 0.06 | 10.0-40.4 | Meandering Edge-Coupled CCS Coupled Line | 1.16 |

According to TABLEs 2 and 3, the 3-dB directional coupler shows a bandwidth of 22.7 GHz from 14.2 GHz to 36.9 GHz with an area of 120.0 μm×240.0 μm and the Marchand balun reveals a frequency range from 10.0 GHz to 40.0 GHz. Such circuits demonstrate the advantages of broader bandwidth and miniaturization and suitability for monolithic microwave integrated circuit (MMIC) designs.

Although specific embodiments have been illustrated and described, it will be obvious to those skilled in the art that various modifications may be made without departing from what is intended to be limited solely by the appended claims.

What is claimed is:

1. A complementary-conducting-strip coupled-line, comprising:

a substrate;

m layers of mesh ground planes, interlacing with m−1 layer(s) of first inter-media-dielectric to form a stack structure on said substrate, said m−1 first inter-media-dielectric layer(s) having a plurality of vias to connect matching mesh ground planes, wherein m is a natural number and m≧2;

a second inter-media-dielectric layer, being on said stack structure; and n metal lines, being on said second inter-media-dielectric layer and being edge-coupled with each other, wherein n is a natural number and n≧2.

2. The complementary-conducting-strip coupled-line according to claim 1, wherein said n metal lines comprise straight-line form.

3. The complementary-conducting-strip coupled-line according to claim 1, wherein said n metal lines comprise L-line form.

4. The complementary-conducting-strip coupled-line according to claim 1, wherein said n metal lines comprise parallel coupling way.

5. The complementary-conducting-strip coupled-line according to claim 1, wherein said n metal lines comprise non-parallel coupling way.

6. The complementary-conducting-strip coupled-line according to claim 1, wherein said n metal lines individually comprise two sub-metal-lines and a plurality of vias, said two sub-metal-lines are on different metal layer of a complementary metal-oxide semiconductor.

7. A complementary-conducting-strip coupled-line, comprising:

a substrate;

m layers of mesh ground planes, interlacing with m-1 layer(s) of first inter-media-dielectric to form a stack structure on said substrate, said m-1 first inter-media-dielectric layer(s) having a plurality of vias to connect matching mesh ground planes, wherein m is a natural number and m≧2;

a second inter-media-dielectric layer, being on said stack structure; and n metal lines, being above said second inter-media-dielectric layer and being broadside-coupled with each other, said n metal lines interlacing with n−1 third inter-media-dielectric layer(s), wherein n is a natural number and n≧2.

8. The complementary-conducting-strip coupled-line according to claim 7, wherein said n metal lines comprise straight-line form.

9. The complementary-conducting-strip coupled-line according to claim 7, wherein said n metal lines comprise L-line form.

10. The complementary-conducting-strip coupled-line according to claim 7, wherein said n metal lines comprise parallel coupling way.

11. The complementary-conducting-strip coupled-line according to claim 7, wherein said n metal lines comprise non-parallel coupling way.

12. The complementary-conducting-strip coupled-line according to claim 7, wherein said n metal lines individually comprise two sub-metal-lines and a plurality of vias, said two sub-metal-lines are on different metal layer of a complementary metal-oxide semiconductor.

13. A complementary-conducting-strip coupled-line, comprising:

a substrate;

m layers of mesh ground planes, interlacing with m−1 layer(s) of first inter-media-dielectric to form a stack structure on said substrate, said m−1 first inter-media-dielectric layer(s) having a plurality of vias to connect matching mesh ground planes, wherein m is a natural number and m≧2;

a second inter-media-dielectric layer, being on said stack structure; and y layers of metal line, interlacing with y−1 third inter-media-dielectric layer(s) and being above said second inter-media-dielectric layer, said y metal line layers individually at least comprising n metal lines being edge-coupled with each other, wherein, n, y are natural numbers and n≧2, y≧2.

14. The complementary-conducting-strip coupled-line according to claim 13, wherein said n metal lines comprise straight-line form.

15. The complementary-conducting-strip coupled-line according to claim 13, wherein said n metal lines comprise L-line form.

16. The complementary-conducting-strip coupled-line according to claim 13, wherein said n metal lines comprise parallel coupling way.

17. The complementary-conducting-strip coupled-line according to claim 13, wherein said n metal lines comprise non-parallel coupling way.

18. The complementary-conducting-strip coupled-line according to claim 13, wherein said n metal lines on adjacent said y metal line layers are broadside-coupled with each other.

19. The complementary-conducting-strip coupled-line according to claim 18, wherein said n metal lines comprise parallel coupling way.

20. The complementary-conducting-strip coupled-line according to claim 18, wherein said n metal lines comprise non-parallel coupling way.

21. The complementary-conducting-strip coupled-line according to claim 13, wherein said n metal lines individually comprise two sub-metal-lines and a plurality of vias, said two sub-metal-lines are on different metal layer of a complementary metal-oxide semiconductor.

22. A complementary-conducting-strip coupled-line, comprising:

a substrate;

a mesh ground plane, being on said substrate;

a first inter-media-dielectric layer, being on said mesh ground plane; and y layers of metal line, interlacing with y−1 second inter-media-dielectric layer(s) and being above said first inter-media-dielectric layer, said y metal line layers individually at least comprising n metal lines being edge-coupled with each other, wherein, n, y are natural numbers and $n \geqq 2$, $y \geqq 2$.

23. The complementary-conducting-strip coupled-line according to claim 22, wherein said n metal lines comprise straight-line form.

24. The complementary-conducting-strip coupled-line according to claim 22, wherein said n metal lines comprise L-line form.

25. The complementary-conducting-strip coupled-line according to claim 22, wherein said n metal lines comprise parallel coupling way.

26. The complementary-conducting-strip coupled-line according to claim 22, wherein said n metal lines comprise non-parallel coupling way.

27. The complementary-conducting-strip coupled-line according to claim 22, wherein said n metal lines on adjacent said y metal line layers are broadside-coupled with each other.

28. The complementary-conducting-strip coupled-line according to claim 27, wherein said n metal lines comprise parallel coupling way.

29. The complementary-conducting-strip coupled-line according to claim 27, wherein said n metal lines comprise non-parallel coupling way.

30. The complementary-conducting-strip coupled-line according to claim 22, wherein said n metal lines individually comprise two sub-metal-lines and a plurality of vias, said two sub-metal-lines are on different metal layer of a complementary metal-oxide semiconductor.

* * * * *